United States Patent [19]

Fujii et al.

[11] 4,412,103

[45] Oct. 25, 1983

[54] DIAPHRAGM FOR AN ELECTRO-ACOUSTIC TRANSDUCER

[75] Inventors: Kiyonobu Fujii, Okayama; Kotaro Ikeda, Ashiya; Kenji Okuno, Kurashiki; Koichi Saito, Kurashiki; Osamu Ohara, Kurashiki, all of Japan

[73] Assignee: Kuraray Co., Ltd., Kurashiki, Japan

[21] Appl. No.: 360,001

[22] Filed: Mar. 19, 1982

[30] Foreign Application Priority Data

| | | | |
|---|---|---|---|
| Mar. 20, 1981 | [JP] | Japan | 56-40662 |
| Apr. 2, 1981 | [JP] | Japan | 56-50367 |
| Jun. 30, 1981 | [JP] | Japan | 56-102666 |

[51] Int. Cl.[3] ..... C10K 13/00; C08K 3/34

[52] U.S. Cl. ..... 179/115.5 R; 181/167; 524/449

[58] Field of Search ..... 524/449; 523/213; 179/138, 115 R, 115.5 R; 181/167

[56] References Cited

U.S. PATENT DOCUMENTS

| | | | |
|---|---|---|---|
| 3,520,845 | 7/1970 | McKeown et al. | 524/449 |
| 3,764,456 | 10/1973 | Woodhams | 524/449 |
| 4,026,384 | 5/1977 | Yamachika et al. | 181/167 |
| 4,340,516 | 7/1982 | Keeney | 524/449 |

FOREIGN PATENT DOCUMENTS

| | | | |
|---|---|---|---|
| 52-75316 | 6/1977 | Japan | 181/167 |
| 53-47816 | of 1978 | Japan . | |
| 55-136796 | of 1980 | Japan . | |
| 55-162695 | of 1980 | Japan . | |
| 56-131660 | 10/1981 | Japan | 524/449 |
| 1563511 | 3/1980 | United Kingdom . | |

*Primary Examiner*—Lewis T. Jacobs

*Attorney, Agent, or Firm*—Oblon, Fisher, Spivak, McClelland & Maier

[57] ABSTRACT

A diaphragm for an electro-acoustic transducer comprising a sheet formed from a mixture of a polymer and mica, where the sheet contains (a) 30 to 95% by weight of a polymer selected from among polyolefins, polyesters, and polyamides and (b) 5 to 70% by weight of mica having a weight-average flake diameter not exceeding 500 microns and a weight-average aspect ratio of at least 10. By adding the specified mica, the sheet has a drastically improved dynamic modulus and a substantially unchanged loss tangent.

12 Claims, No Drawings

DIAPHRAGM FOR AN ELECTRO-ACOUSTIC TRANSDUCER

BACKGROUND OF THE INVENTION

1. Field of the Invention:

This invention relates to a diaphragm for an electro-acoustic transducer, and more particularly, to a diaphragm for use in a moving coil loudspeaker.

2. Description of the Prior Art:

Diaphragms for electro-acoustic transducers are fundamentally required to have a high dynamic modulus, a moderate loss tangent, and a moderate density. They were previously made mainly of paper, but recently thermoplastics films, such as polyolefin, polyester and polyamide films, have come into frequent use, since they provide excellent acoustical properties, have a high degree of moldability, and lend themselves to mass production at a low cost. For example, British Pat. No. 1,563,511 discloses an electro-acoustic transducer diaphragm made of polyolefin film.

To improve acoustical properties, efforts have been made to develop a diaphragm having a higher dynamic modulus. A known method of improving the dynamic modulus of a polymeric material is incorporation of a reinforcing filler. If a fibrous reinforcer, such as glass or carbon fibers is used, however, an anisotropic diaphragm is formed because of the orientation of fibers that takes place during the extrusion forming of the diaphragm. If a flaky reinforcer, such as graphite or seashell powder, is employed, it is difficult to obtain a diaphragm having a satisfactorily improved dynamic modulus. Laid-Open Japanese Patent Specification No. 162695/1980 discloses such a diaphragm for an electro-acoustic transducer that is formed from a thermoplastic resin and flaky graphite. The use of mica for making a diaphragm for an electro-acoustic transducer is also known. Laid-Open Japanese Patent Specification No. 47816/1978 discloses a diaphragm formed by a papermaking machine from a mixture of cellulose fibers and mica dispersed in water, and Laid-Open Japanese Patent Specification No. 75316/1977 discloses a diaphragm formed by a papermaking machine from a mixture of carbon fibers and mica. These diaphragms have, however, not met any success in practice since mica, which inherently does not have any entangling property, is difficult to handle with a papermaking machine. The formation of a loudspeaker diaphragm from a sheet made of a mixture of polyvinyl chloride and mica is also known, as disclosed in Laid-Open Japanese Patent Specification No. 136796/1980, but no diaphragm having satisfactory acoustical properties as proposed therein has actually been obtained.

SUMMARY OF THE INVENTION

It is, therefore, an object of this invention to provide a diaphragm for an electro-acoustic transducer having a high dynamic modulus, a moderate loss tangent, and a moderate density.

It is another object of this invention to provide a diaphragm for an electro-acoustic transducer that is formed from a polyolefin, polyester, or polyamide; does not have any anisotrophy; and has a high dynamic modulus, while maintaining the properties of the polymer (particularly the loss tangent).

It is a further object of this invention to provide a diaphragm for an electro-acoustic transducer that has excellent acoustical properties and is easy to mold.

These and other objects that will hereinafter become more readily apparent have been attained by providing a diaphragm for an electro-acoustic transducer that is made from a sheet formed from a mixture of a polymer and mica and comprising (a) 30 to 95% by weight of a polymer selected from the group consisting of polyolefins, polyesters, and polyamides and (b) 5 to 70% by weight of mica having a weight-average flake diameter of 500 microns at maximum and a weight-average aspect ratio of at least 10.

DETAILED DESCRIPTION OF THE PREFERRED EMBODIMENTS

According to this invention, it is possible to use a polyolefin, i.e., a polymer of aliphatic olefins having 2 to 6 carbon atoms, such as polyethylene (particularly high-density polyethylene), polypropylene (particularly isotactic polypropylene), polybutene, poly(3-methylbutene-1), and poly(4-methylpentene-1), or a crystallizable copolymer containing at least 50 mol % of the above-mentioned monomer unit as a main component. In this invention, the crystallizable copolymer has a crystallinity of at least 25%. The second copolymerizable monomer can be another olefin monomer such as vinyl acetate, maleic anhydride, methyl acrylate or methacrylate, acrylic or methacrylic acid, or the like. These copolymerizable monomers are used in a quantity that does not adversely affect the crystallinity of the polymer (usually not exceeding 20 mol %). It is possible to use a random, block, or graft copolymer. According to this invention, isotactic polypropylene is a preferred polymer, as it is easy to form therefrom a heat-resistant diaphragm at a low cost. It is also desirable to use an isotactic polypropylene copolymer having an ethylene content not exceeding 30% by weight, and preferably in the range of 2 to 15% by weight. Further, a blend polymer obtained by mixing two or more above-mentioned polymers may be used; for example, a low-density polyethylene or ethylene-propylene copolymer may be added to isotactic polypropylene.

According to this invention, the diaphragm is formed from a mixture of a polyolefin and mica. The mixture may have a melt index preferably not exceeding 3.5 g/10 min., more preferably not exceeding 3.0 g/10 min., and most preferably not exceeding 2.0 g/10 min. The melt index may be determined in accordance with the requirements of ASTM D1238; if the polyolefin is, for example, polypropylene, the melt index is expressed by the polymer melt flow rate (g/10 min.) at 230° C. If the mixture has an melt index exceeding 3.5 g/10 min., a sheet formed from the mixture is likely to develop wrinkles or other defects when a diaphragm is formed from the sheet by vacuum forming, pressing, stamping, or otherwise. A polyolefin and mica mixture having a low melt index can be obtained by employing a polyolefin having a low melt index.

According to this invention, it is also possible to use a thermoplastic polyester, for example, a polymer of an alkylene glycol ester of terephthalic or isophthalic acid. Suitable polyesters contain, for example, an ester formed from alkylene glycols having 2 to 10 carbon atoms, such as ethylene glycol, tetramethylene glycol, hexamethylene glycol, or decamethylene glycol. It is preferable to use polyalkylene glycol terephthalate or isophthalate containing glycols having 2 to 4 carbon atoms, or a copolyester of terephthalic and isophthalic acid containing not more than 30 mol % of isophthalic acid. It is more preferable to use polyethylene terephthalate, polypropylene terephthalate, polybutylene terephthalate, polybutylene isophthalate, a polybutylene terephthalate-isophthalate copolymer, or the like. Polyethylene and polybutylene terephthalate are both suitable and are commonly available, though the latter is preferred because of the higher loss tangent of the resulting diaphragm.

The diaphragm of this invention may also be formed from a polyamide obtained by the polymerization of a lactam or aminocarboxylic acid having 6 to 12 carbon atoms, or by the polycondensation of a diamine and a dicarboxylic acid, or a copolymer thereof, or a mixture thereof. Suitable examples include nylon 6, nylon 6/6, nylon 6/10, nylon 6/12, nylon 11, or nylon 12, or a copolymer thereof, or a mixture thereof, but it is preferred to use nylon 6 or nylon 6/6. It is also possible to use a crystallizable polyamide obtained by the polycondensation of a diamine, such as hexamethylenediamine, metaxylenediamine, paraaminocyclohexylmethane, or 1,4-bis(aminomethyl)cyclohexane, and a dicarboxylic acid, such as terephthalic, isophthalic, adipic, or sebacic acid, or a copolymer thereof with nylon 6 or 6/6.

It is possible to use various types of mica, such as muscovite, phlogopite, or fluorophlogopite, but it is necessary to choose one having a weight-average flake diameter not exceeding 500 microns and a weight-average aspect ratio of at least 10. Mica is crushed to some degree when it is mixed into the molten polymer when the sheet is being formed. The terms "flake diameter" and "aspect ratio" of mica as herein used indicate those characteristics of mica determined after it has been mixed with the polymer.

The weight-average flake diameter of mica ($\overline{D}$) is obtained by the equation, $$\overline{D}=\sqrt{2}D_{50},$$

where $D_{50}$ stands for the sieve opening diameter that passes 50% by weight of mica flakes. The value ($D_{50}$) is determined by plotting various sizes of sieve opening versus weights of mica flakes remaining on the sieves on a Rosin-Rammlar diagram.

The weight-average aspect ratio of mica is obtained by the equation:

$$\alpha=\overline{D}/\overline{t},$$

where $\overline{t}$ stands for the weight-average thickness of mica. The value (E) is determined using a powder film method described in the following reports, which are herein incorporated by reference:

1. C. E. Capes and R. D. Coleman: Ind. Eng. Chem. Foundam., Vol. 12, No. 1 (1973).

2. Nishino and Arakawa: Zairyo (text: Japanese), Vol. 27, No. 298 (1978). It is calculated from the following equation, based on the result of the measurement, $$\overline{t}=\frac{1}{\rho(1-\epsilon)S},$$

where $\rho$ stands for the true specific gravity of the mica flakes, $\epsilon$ stands for the void volume, and S stands for the area of a film formed on a water surface by a unit weight of mica flakes. For convenience, the value ($\epsilon$) may be assumed to be 0.1.

If mica having a weight-average flake diameter exceeding 500 microns is used to form a diaphragm, the mica flakes easily separate from the diaphragm surface, and the diaphragm is very difficult to form by melt processing. It is preferable to use mica having a weight-average flake diameter of 10 to 300 microns.

The weight-average aspect ratio of the mica for use in this invention should be at least 10, usually in the range of 10 to 1000. If mica having a weight-average aspect ratio of less than 10 is used to form a diaphragm, the diaphragm does not have a satisfactorily improved dynamic modulus, and its acoustical properties are unsatisfactory.

The mixture of the polymer and mica from which the diaphragm of this invention is formed contains 30 to 95% by weight of the polymer and 5 to 70% by weight of mica. If the mixture contains less than 5% by weight of mica, the diaphragm does not have a satisfactorily improved dynamic modulus. If the mixture contains more than 70% by weight of mica, it is difficult to mold the sheet from which the diaphragm is formed. It is preferred to employ mica in the quantity of 10 to 60% by weight and the polymer in the quantity of 40 to 90% by weight. In order to increase the dynamic modulus of the diaphragm and prevent separation of mica flakes from the diaphragm surface, it is advisable to use mica having its surface treated with a surface-treated agent such as a silane coupling agent, thereby improving the interfacial bonding strength between the polymer and the mica. Examples of suitable silane coupling agents include $\gamma$-aminopropyltrimethoxysilane, N-($\beta$-aminoethyl)-$\gamma$-aminopropyltrimethoxysilane, $\gamma$-mercaptropropyltriethoxysilane, and $\gamma$-glycidoxypropyltrimethoxysilane. In order to apply the surface-treating agent to mica, mica powder may be immersed in a solution of the agent in water or an organic solvent and dried. Alternatively, the agent may be incorporated directly into a mixture of the polymer and mica when the mixture is prepared. Although there is no particular limitation to the quantity of the surface-treating agent to be used, it is usually satisfactory to employ 0.1 to 3% by weight of the agent based on the weight of the mica.

When the diaphragm of this invention is manufactured, it is possible to use in addition to mica an auxiliary filler, such as talc, calcium carbonate, wollastonite, glass beads, magnesium hydroxide, silica, graphite, glass flakes, barium sulfate, alumina, potassium titanate fibers, processed mineral fibers, glass fibers, carbon fibers, or aramide fibers, usually in a quantity not exceeding 40% by weight of the polymer and mica, and not exceeding 95% (preferably 50%) by weight of mica. It is also possible to add a pigment, a plasticizer, a stabilizer, a lubricant, or the like, if required.

The diaphragm of this invention is manufactured from a sheet formed from the polymer and mica. The sheet is preferably formed from a molten mixture of the polymer and mica by extrusion in a customary manner, as this method facilitates sheet forming. Further, the sheet may be molded into a desired shape by vacuum forming, pressing, stamping, or otherwise, according to choice.

Although there are no particular limitations to the thickness of the diaphragm prepared according to this invention, it is preferred for the diaphragm to have a thickness of 0.1 to 0.9 mm, and particularly 0.2 to 0.7 mm. A diaphragm having a thickness of less than 0.1 mm is low in strength, while a diaphragm having a thickness greater than 0.9 mm is heavy and requires a strong and expensive magnet.

The diaphragm thus obtained is incorporated into a loudspeaker of any type known in the art. British Pat. No. 1,563,511, discloses the construction of a typical moving coil type loudspeaker in which the diaphragm is employed in the form of a hyperbolic cone or tweeter dome.

The diaphragm of this invention has a drastically higher dynamic modulus than that of any conventional diaphragm formed solely from a polymer and has a substantially unchanged loss tangent. Further it is easy to manufacture, and therefore provides an excellent loudspeaker diaphragm. The diaphragm of this invention can maintain its high dynamic modulus even at a high temperature, and is, therefore, fully capable of withstanding any elevation in ambient temperature that may occur in an acoustical apparatus in which the diaphragm is employed, or any temperature elevation that will occur when any such acoustical apparatus is being assembled, for example, when the diaphragm is bonded to a base.

Having now generally described this invention, the same will be better understood by reference to certain specific examples which are included herein for purposes of illustration only and are not intended to be limiting of the invention or any embodiment thereof, unless specified.

EXAMPLE I

Phlogopite having a weight-average flake diameter of 21 microns and having a surface treated with 0.5% by weight, based on the mica of $\gamma$-aminopropyltriethoxysilane and crystalline polypropylene having a melt index of 1 g/10 min. were mixed in molten form using a single screw extruder at 230° C. to form pellets. The pellets were extruded at 240° C. to form a polypropylene-mica sheet containing 60% by weight of phlogopite and having a thickness of 300 microns. The mica in the sheet had a weight-average flake diameter of 18 microns and an aspect ratio of 12.

The dynamic modulus E' and loss tangent tan $\delta$ of the sheet thus obtained were measured at a frequency of 110 Hz and a temperature of 20° C. by employing a Toyo Baldwin Vibron DDV-2. Its density $\rho$ was measured by employing ethanol in accordance with the method specified by JIS K7112A. The transmission speed of sound was determined by a dynamic modular tester. The temperature at which the sheet had a dynamic modulus E' of $10^9$ dynes/cm$^2$ was obtained in accordance with the temperature dependence of the dynamic modulus E' to provide a standard for the evaluation on heat resistance. The specific modulus, sound velocity, loss tangent, and heat resistance of the sheet determined as hereinabove described were all excellent as shown in TABLE 1 below. Twenty loudspeaker cones were vacuum formed from the sheet at a temperature of 190° C. The sheet showed an excellent degree of vacuum formability and did not produce any defective product.

EXAMPLES 2 AND 3

Sheets having a thickness of 500 microns and containing 30% by weight (EXAMPLE 2) or 10% by weight (EXAMPLE 3) of phlogopite were formed by employing phlogopite having a weight-average flake diameter of 40 microns (EXAMPLE 2) or 230 microns (EXAMPLE 3). In all other respects, the procedures of EXAMPLE 1 were repeated for the manufacture and testing of the sheets. The results are shown in TABLE 1. The specific modulus, sound velocity, loss tangent, and vacuum formability of the sheets were all quite satisfactory.

EXAMPLE 4

A sheet having a thickness of 200 microns was formed from a mixture of a propylene-ethylene block copolymer having a melt index of 3.5 g/10 min. (an ethylene content of 6% by weight) and phlogopite powder having a weight-average flake diameter of 90 microns, with the phlogopite powder forming 30% by weight of the mixture. In all other respects, the procedures of EXAMPLE 1 were repeated for the manufacture and testing of the sheet. The test results are shown in TABLE 1. As is obvious from TABLE 1, the specific modulus, sound velocity, loss tangent, heat resistance, and vacuum formability of the sheet were all quite satisfactory.

EXAMPLES 5 and 6

Sheets having a thickness of 400 microns were formed from a mixture of polypropylene having a melt index of 5 g/10 min. (EXAMPLE 5) or a propylene-ethylene block copolymer having an ethylene content of 6% by weight and a melt index of 5 g/10 min. (EXAMPLE 6) and 30% by weight of phlogopite powder having a weight-average flake diameter of 40 microns. In all other respects, the procedures of EXAMPLE 1 were repeated for the manufacture and testing of the sheets. The specific modulus, sound velocity, and heat resistance of the sheets were satisfactory as shown in TABLE 1, but the sheets sagged when they were heated for vacuum forming into loudspeaker cones. Twenty loudspeaker cones were formed from each sheet, but wrinkles were found in five cones formed from the sheet of EXAMPLE 5 and four cones formed from the sheet of EXAMPLE 6. The sheets of EXAMPLES 5 and 6 were both inferior in vacuum formability to those of EXAMPLES 1 to 4.

EXAMPLE 7

High density polyethylene having a melt index of 2 g/10 min. and 50% by weight of phlogopite powder having a weight-average flake diameter of 90 microns were mixed and extrusion molded at 160° C. to form a sheet. In all other respects, the procedures of EXAMPLE 1 were repeated for the manufacture and testing of the sheet. The test results are shown in TABLE 1. The specific modulus, sound velocity, loss tangent, and heat resistance of the sheet were quite satisfactory. The sheet also showed superior vacuum formability when it was vacuum formed at 130° into a diaphragm of cone form.

TABLE 1

| | Composition | | | | Sheet Performance | | | | | | | | |
|---|---|---|---|---|---|---|---|---|---|---|---|---|---|
| | | Mica | | | | | | | | | | | |
| 25 ample | Matrix resin | Flake dia. (μm) | Aspect ratio | Proportion (wt %) | Melt index g/10 min. | Density $\rho$ g/cm$^3$ | Dynamic modulus E' $10^{10}$ dyn/cm$^2$ | Specific modulus E'/$\rho$, m$^2$/sec$^2$ | Sound velocity m/sec. | Loss tangent | Heat resistance °C. | Vac. form tem. °C. | Rejects % |
| 1 | PP | 18 | 12 | 60 | 0.85 | 1.50 | 6.8 | $4.5 \times 10^6$ | 2,630 | 0.06 | 130 | 190 | 0 |
| 2 | PP | 33 | 25 | 30 | 0.90 | 1.14 | 5.2 | $4.6 \times 10^6$ | 2,650 | 0.06 | 130 | 190 | 0 |
| 3 | PP | 160 | 45 | 10 | 0.96 | 0.98 | 3.0 | $3.1 \times 10^6$ | 2,100 | 0.07 | 90 | 190 | 0 |
| 4 | PP-EC | 75 | 39 | 30 | 3.2 | 1.14 | 5.1 | $4.5 \times 10^6$ | 2,680 | 0.06 | 125 | 180 | 5 |
| 5 | PP | 34 | 25 | 30 | 4.6 | 1.14 | 4.7 | $4.1 \times 10^6$ | 2,420 | 0.06 | 130 | 190 | 25 |
| 6 | PP-EC | 34 | 25 | 30 | 4.1 | 1.14 | 4.2 | $3.7 \times 10^6$ | 2,380 | 0.06 | 115 | 180 | 20 |
| 7 | HDPE | 75 | 30 | 50 | 1.6 | 1.41 | 7.7 | $5.5 \times 10^6$ | 3,370 | 0.05 | 93 | 130 | 0 |

PP: Polypropylene
PP-EC: Polypropylene-ethylene copolymer
HDPE: High density polyethylene

COMPARATIVE EXAMPLES 1 TO 3

Sheets were formed from polypropylene and phlogopite powder having a weight-average flake diameter of 19 microns (COMPARATIVE EXAMPLES 1 and 3) or 15 microns (COMPARATIVE EXAMPLE 2). In all other respects, the procedures of EXAMPLE 1 were repeated for the manufacture and testing of the sheets. The composition of the sheets and the test results are shown in TABLE 2. As is obvious from TABLE 2, the sheets of COMPARATIVE EXAMPLES 1 and 2 were unsatisfactory in specific modulus and heat resistance. COMPARATIVE EXAMPLE 3 encountered difficulty in extrusion forming of the sheet and vacuum forming of a loudspeaker cone from the sheet. The properties of the sheets showed improvements over those of the sheets formed solely from polypropylene, but the improvements were not so distinct as those achieved in the EXAMPLES of this invention.

COMPARATIVE EXAMPLE 4

A sheet was formed solely from polypropylene of the type used in EXAMPLE 1. The results are shown in TABLE 2. Its specific modulus was unsatisfactory for forming as diaphragm for an electro-acoustic transducer.

COMPARATIVE EXAMPLE 5

A sheet was formed solely from high density polyethylene of the type used in EXAMPLE 7. The results are shown in TABLE 2. Its specific modulus and heat resistance were unsatisfactory for forming a diaphragm for an electroacoustic transducer.

TABLE 2

| | Composition | | | | | | | | | |
|---|---|---|---|---|---|---|---|---|---|---|
| | | Mica | | | | | | | | |
| Comparative Example | Matrix resin | Flake dia. (μm) | Aspect ratio | Proportion (wt %) | Density $\rho$ g/cm$^3$ | Dynamic modulus E' $10^{10}$ dyn/cm$^2$ | Specific modulus E'/$\rho$ m$^2$/sec$^2$ | Loss tangent tan $\delta$ | Heat resistance °C. | Vacuum forming temp. °C. |
| 1 | PP | 15 | 10 | 4 | 0.96 | 1.4 | $1.5 \times 10^6$ | 0.07 | 65 | 180 |
| 2 | PP | 12 | 7 | 60 | 1.52 | 3.2 | $2.1 \times 10^6$ | 0.05 | 95 | 190 |
| 3 | PP | 15 | 10 | 75 | 1.65 | 4.5 | $2.7 \times 10^6$ | 0.04 | 125 | 200 |
| 4 | PP | — | — | 0 | 0.91 | 1.1 | $1.2 \times 10^6$ | 0.06 | 55 | 180 |
| 5 | HDPE | — | — | 0 | 0.95 | 1.0 | $1.1 \times 10^6$ | 0.06 | 40 | 130 |

PP: Polypropylene
HDPE: High density polyethylene

EXAMPLE 8

Polybutylene terephthalate (PBT) having an intrinsic viscosity of 1.0 dl/g and muscovite having a surface treated with $\gamma$-aminopropyltriethoxysilane (0.5% by weight based on the mica) and having a weight-average flake diameter of 140 microns were mixed in a single screw extruder at 250° C. to form pellets. The pellets were extrusion molded at 240° C. to form a polyester-mica sheet containing 40% by weight of muscovite and having a thickness of 400 microns. The mica in the sheet had a weight-average flake diameter of 90 microns and an aspect ratio of 35.

TABLE 3 shows the results of the tests conducted on the sheet thus obtained. The specific modulus, loss tangent, and heat resistance of the sheet were all quite satisfactory. A loudspeaker cone diaphragm was easily vacuum formed from the sheet at 230° C.

COMPARATIVE EXAMPLE 6

A sheet was formed solely from polybutylene terephthalate of the type used in EXAMPLE 8. The test results are shown in TABLE 3. Its specific modulus and heat resistance were unsatisfactory.

EXAMPLE 9

A sheet having a thickness of 200 microns was formed from polyethylene terephthalate (PET) having an intrinsic viscosity of 0.75 dl/g and muscovite powder having a weight-average flake diameter of 140 microns by melt mixing and extrusion forming at 270° C. Otherwise procedures of EXAMPLE 8 were repeated. Its specific modulus, loss tangent, and heat resistance were quite satisfactory as shown in TABLE 3. A loudspeaker cone was easily formed from the sheet by vacuum forming at 250° C.

COMPARATIVE EXAMPLE 7

A sheet was formed solely from polyethylene terephthalate of the type used in EXAMPLE 9. The test results are shown in TABLE 3. Its specific modulus and heat resistance were unsatisfactory.

EXAMPLES 10 AND 11

A sheet having a thickness of 300 microns was formed from nylon 6 having a melt index of 5 g/10 min.

(EXAMPLE 10) or nylon 6/6 having a melt index of 5 g/10 min. (EXAMPLE 11) and muscovite powder having a weight-average flake diameter of 140 microns by melt mixing and extrusion forming at 250° for nylon 6 or at 270° C. for nylon 6/6. Otherwise the procedures of EXAMPLE 8 were repeated. The specific modulus, loss tangent, and heat resistance of the sheets were quite satisfactory as shown in TABLE 3. Loudspeaker cones were easily formed from the sheets by vacuum forming at 230° C.

COMPARATIVE EXAMPLES 8 TO 11

Sheets were formed from polypropylene and a filler other than mica, such as talc or flaky graphite, and also from a resin of the type not used in this invention, mainly polyvinyl chloride, and mica. The composition of the sheets and the test results are shown in TABLE 4. All of the sheets thus obtained were unsatisfactory in performance.

TABLE 3

| | Composition | | | | Sheet Performance | | | | | |
|---|---|---|---|---|---|---|---|---|---|---|
| | | Mica | | | | | | | | |
| | Matrix resin | Flake dia. (μm) | Aspect ratio | Proportion (wt %) | Density g/cm$^3$ | Dynamic modulus E' $10^{10}$ dyn/cm$^2$ | Specific modulus E'/ m$^2$/sec$^2$ | Loss tangent tan | Heat resistance °C. | Vacuum forming temp. °C. |
| EXAMPLE 8 | PBT | 90 | 35 | 40 | 1.65 | 13.5 | $8.2 \times 10^6$ | 0.16 | 205 | 230 |
| COMPARATIVE EXAMPLE 6 | PBT | — | — | 0 | 1.31 | 2.5 | $1.9 \times 10^6$ | 0.16 | 55 | 230 |
| EXAMPLE 9 | PET | 90 | 35 | 40 | 1.72 | 14.2 | $8.3 \times 10^6$ | 0.05 | 210 | 250 |
| COMPARATIVE EXAMPLE 7 | PET | — | — | 0 | 1.39 | 2.7 | $1.9 \times 10^6$ | 0.05 | 75 | 250 |
| EXAMPLE 10 | Nylon 6 | 90 | 35 | 40 | 1.50 | 6.5 | $4.3 \times 10^6$ | 0.07 | 180 | 230 |
| EXAMPLE 11 | Nylon 66 | 90 | 35 | 40 | 1.49 | 6.7 | $4.5 \times 10^6$ | 0.07 | 190 | 250 |

TABLE 4

| | Composition | | | | | | Sheet Performance | | | |
|---|---|---|---|---|---|---|---|---|---|---|
| | | | Filler | | | | | | | |
| COMPARATIVE EXAMPLE | Matrix resin | Kind | Particle dia. | Aspect ratio | Proportion (wt %) | Method of sheet forming | Density g/cm$^3$ | Dynamic modulus E' $10^{10}$ dyn/cm$^2$ | Specific modulus E'/ m$^2$/sec$^2$ | Loss tangent tan δ |
| 8 | PP | Talc | 7 | — | 40 | Melt extrusion | 1.20 | 3.5 | $2.9 \times 10^6$ | 0.04 |
| 9 | PP | Flaky graphite | 20 | — | 40 | Melt extrusion | 1.19 | 2.2 | $1.8 \times 10^6$ | 0.05 |
| 10 | PVC(90) + DOP (10) | Mica | 75 | 30 | 40 | Roll mixing, and rolling | 1.75 | 3.5 | $2.0 \times 10^6$ | 0.08 |
| 11 | PVC(70) + NBR(20) + DOP(10) | " | 75 | 30 | 40 | Roll mixing, and rolling | 1.70 | 2.1 | $1.2 \times 10^6$ | 0.18 |

PVC: Polyvinyl chloride
DOP: Dioctyl phthalate
NBR: Acrylonitrile butadiene rubber
( ): wt %

The invention now being fully described, it will be apparent to one of ordinary skill in the art that many changes and modifications can be made thereto without departing from the spirit or scope of the invention as set forth herein.

What is claimed as new and desired to be secured by Letters Patent of the United States is:

1. A moving coil loudspeaker comprising a diaphragm for an electro-acoustic transducer wherein said diaphragm comprises a sheet formed from a mixture of a polymer and mica, wherein said sheet comprises:

(a) 30 to 95% by weight of a polymer selected from the group consisting of polyolefins, polyesters, and polyamides; and (b) 5 to 70% by weight of mica having a weight-average flake diameter of no more than 500 microns and a weight-average aspect ratio of at least 10.

2. A loudspeaker as set forth in claim 1, wherein said polymer is a polyolefin.

3. A loudspeaker as set forth in claim 2, wherein said polyolefin is selected from the group consisting of polypropylene and crystallizable copolymers containing at least 50 mol % of propylene units.

4. A loudspeaker as set forth in claim 3, wherein said polyolefin has a melt index of no more than 3.5 g/10 min.

5. A loudspeaker as set forth in claim 1, wherein said polymer is a polyester.

6. A loudspeaker as set forth in claim 5, wherein said polyester is selected from the group consisting of polyethylene terephthalate and polybutylene terephthalate.

7. A loudspeaker as set forth in claim 1, wherein said polymer is a polyamide.

8. A loudspeaker as set forth in claim 7, wherein said polyamide is selected from the group consisting of nylon 6 and nylon 6/6.

9. A loudspeaker as set forth in claim 1, wherein said mica is treated with a silane coupling agent.

10. A loudspeaker as set forth in claim 1, wherein said sheet comprises 40 to 90% by weight of said polymer, and 10 to 60% by weight of said mica.

11. A loudspeaker as set forth in claim 1, wherein said sheet is obtained by melt forming said mixture.

12. A loudspeaker as set forth in claim 11, wherein said sheet is formed by melt extrusion.

* * * * *